US005759062A

United States Patent [19]

Chen

[11] Patent Number: 5,759,062

[45] Date of Patent: Jun. 2, 1998

[54] LAMP SOCKET WITH WATER SEAL MEANS FOR X'MAS TREE LIGHT SET

[76] Inventor: Ming-Hsiung Chen, 7F, No. 16, Alley 3, Lane 227, Nung-An St., Taipei, Taiwan

[21] Appl. No.: 769,761

[22] Filed: Dec. 19, 1996

[51] Int. Cl.[6] ..... H01R 4/24

[52] U.S. Cl. ..... 439/419; 439/280

[58] Field of Search ..... 439/271, 278–280, 439/414, 417, 419, 611, 619, 356

[56] References Cited

U.S. PATENT DOCUMENTS

| | | | |
|---|---|---|---|
| 2,119,452 | 5/1938 | Woodhead . | |
| 2,800,635 | 7/1957 | Christenbery . | |
| 3,101,984 | 8/1963 | Wieckmann . | |
| 4,660,916 | 4/1987 | Williams, Jr. . | |
| 5,100,335 | 3/1992 | Yamamoto . | |
| 5,161,881 | 11/1992 | Myson | 439/419 X |
| 5,421,742 | 6/1995 | Huang . | |
| 5,474,467 | 12/1995 | Chen . | |
| 5,643,006 | 7/1997 | Wang et al. | 439/419 |
| 5,660,560 | 8/1997 | Cheng et al. . | |
| 5,667,296 | 9/1997 | Cheng et al. . | |

FOREIGN PATENT DOCUMENTS

| | | |
|---|---|---|
| 433831 | 2/1912 | France . |
| 119539 | 10/1918 | United Kingdom . |
| 412939 | 7/1934 | United Kingdom . |
| 2253045 | 8/1992 | United Kingdom . |

*Primary Examiner*—Khiem Nguyen
*Attorney, Agent, or Firm*—Ladas & Parry

[57] ABSTRACT

A lamp socket including a rubber top water seal member and a rubber bottom water seal member respectively fastened to two opposite ends of the socket body thereof to stop rain water from passing to the inside of the body, the rubber top water seal member having a bottom mounting groove engaged with the top edge of the socket body, two plug portions fitted into two opposite ends of a transverse wire groove of the socket body to support an electrical wire in the transverse wire groove, and two pairs of wedge blocks forced into close contact with the periphery of the electrical wire at the top by a pressure block of a socket cap, which is fastened to the socket body to hold down the electrical wire, the rubber bottom water seal having an upright annular flange fitted into an annular bottom groove at the bottom end of the socket body, a plurality of upright hooks raised from the upright annular flange and hooked in respective hook hole in the socket body, and an inward annular flap forced into close contact with the periphery of the bulb installed.

2 Claims, 3 Drawing Sheets

LAMP SOCKET WITH WATER SEAL MEANS FOR X'MAS TREE LIGHT SET

BACKGROUND OF THE INVENTION

The present invention relates to lamp sockets for Christmas tree light sets, and more particularly to such a lamp socket which is equipped with a top water seal member adapted to seal the gap between the socket body and the socket cap around the electrical wire, and a bottom water seal member adapted to seal the gap between the bottom end of the socket body and the periphery of the bulb.

In most advanced countries, the specifications of electrical lamp sockets are strictly defined against an electrical leakage. For example, "UL" in the USA, "CAS" in Canada define safety respectively define strict specifications on lamp socket. However, these standards do not have strict requirements on water sealing arrangement. When a Christmas tree light set is hung on a Christmas tree outdoors during a raining day, rain water may pass to the inside of the lamp sockets to damp the internal circuit, causing a short circuit or an electrical leakage.

SUMMARY OF THE INVENTION

The present invention has been accomplished under the circumstances in view. According to one aspect of the present invention, a rubber top water seal member and a rubber bottom water seal member are respectively fastened to the top and bottom ends of the socket body to seal the gap between the socket body and the socket cap and the gap between the socket body and the bulb, and therefore rain water is prohibited from passing to the inside of the socket body. According to another aspect of the present invention, the rubber top water seal member comprises a bottom mounting groove engaged with the top edge of the socket body, two plug portions respectively fitted into two opposite ends of a transverse wire groove of the socket body to support an electrical wire in the transverse wire groove, and two pairs of wedge blocks forced into close contact with the periphery of the electrical wire at the top by the pressure block of the socket cap, which is fastened to the socket body to hold down the electrical wire; the rubber bottom water seal comprises an upright annular flange fitted into an annular bottom groove at the bottom end of the socket body, a plurality of upright hooks raised from the upright annular flange and hooked in respective hook hole in the socket body, and an inward annular flap forced into close contact with the periphery of the bulb installed.

DETAILED DESCRIPTION OF THE PREFERRED EMBODIMENT

Figure 1:
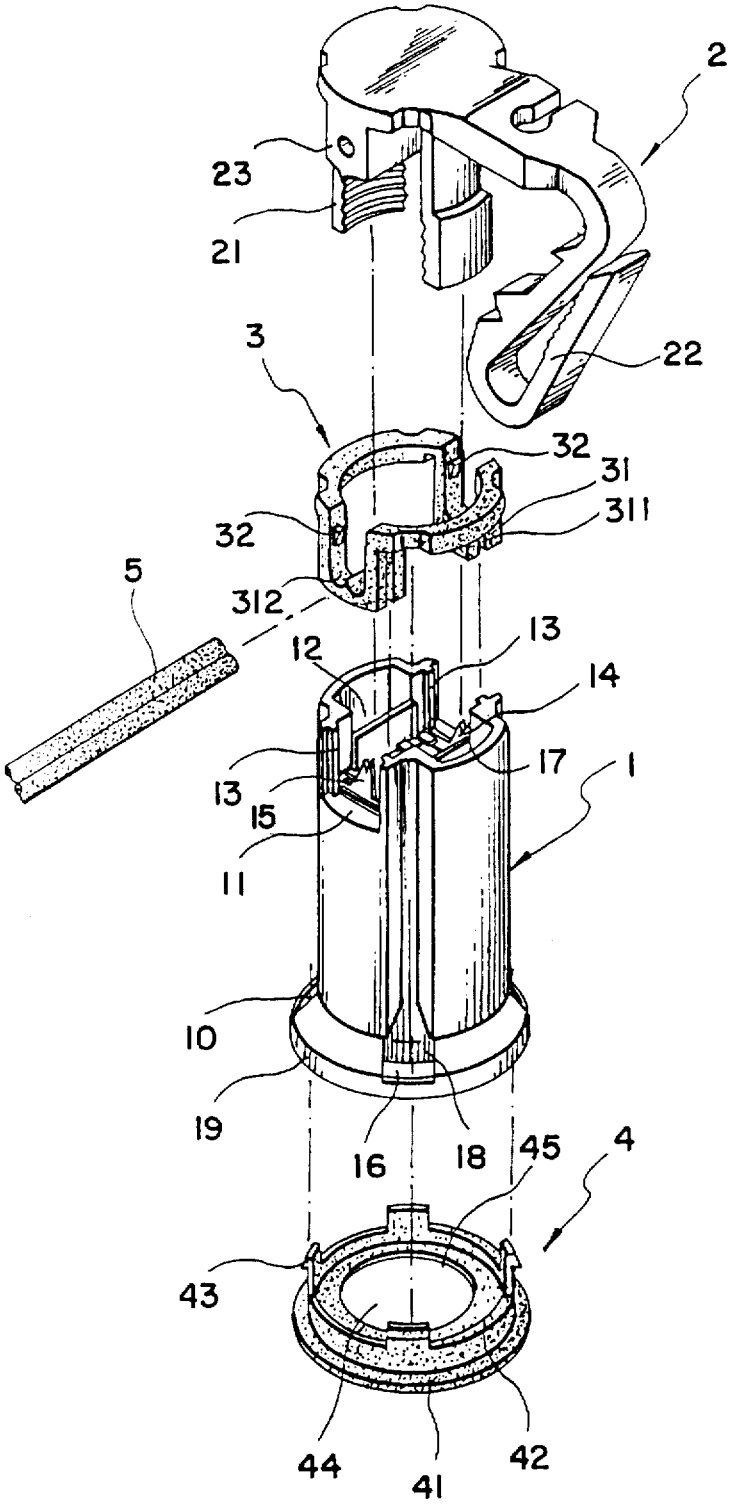
FIG. 1 is an exploded view of a lamp socket according to the present invention.

Referring to FIG. 1, a lamp socket in accordance with the present invention is generally comprised of a socket body 1, a socket cap 2, a top water seal member 3, and a bottom water seal member 4.

The socket body 1 comprises a transverse wire groove 11 at the top, two vertical retaining holes 12 at the close top end thereof at two opposite sides of the transverse wire groove 11 adapted for receiving an electrical wire 5, a positive metal contact plate 14 and a negative metal contact plate 15 respectively mounted on the inside and having a respective pointed top end projecting into the transverse wire groove 11 for piercing the insulator of the electrical wire 5 to make contact with a respective inductor therein, two pairs of vertical rails 13 bilaterally disposed at two opposite ends of the transverse wire groove 11, an annular bottom groove 10 defined between an inside annular wall 18 and an outside annular wall 19 around the bottom opening thereof (the bottom opening of the socket body 1 is adapted for receiving a bulb), and a plurality of hook holes 16 in the outward annular wall 19. The socket cap 2 comprises a downward pressure block 23 raised from the bottom side, and two downward hooks 21 respectively extended from the bottom side and at two opposite sides of the downward pressure block 23, and a clip 22 raised from the periphery for mounting. The downward hooks 21 are adapted for fastening to the retaining holes 12 of the socket body 1, having a respective inner side threaded for engaging a threaded base of a bulb. The downward pressure block 23 fits the transverse wire groove 11 of the socket body 1, and is adapted for pressing the electrical wire 5 against the pointed top ends of the metal contact plates 14, 15. The top water seal member 3 is molded from rubber and fits the periphery of the top end of the socket shell 1, comprising two downward plug portions 31 fitting the two opposite ends of the transverse wire groove 11 of the socket body 1, two pairs of vertical guide grooves 311 respectively and bilaterally disposed at the downward plug portions 31 and adapted for receiving the vertical rails 13 of the socket body 1, two double-recess bearing portions 312 respectively formed in the downward plug portions 31 in the middle and adapted for supporting the electrical wire 5, two symmetrical pairs of wedge blocks 32 respectively and bilaterally raised from the downward plug portions 31 at an inner side above the elevation of the double-recess bearing portions 312, and a bottom mounting groove 33 at the bottom side adapted for receiving the top edge 17 of the socket body 1 (see FIG. 2). Each wedge block 32 has a broad top side, and a narrow bottom side. The bottom water seal member 4 is molded from rubber, comprising a flat annular base 41, an upright annular flange 42 raised from the flat annular base 41, a plurality of upright hooks 43 respectively raised from the upright annular flange 42 and adapted for hooking in the hook holes 16 of the socket body 1, an inward annular flap 45 inwardly and horizontally extended from the flat annular base 41 and defining a center through hole 44.

Figure 2:
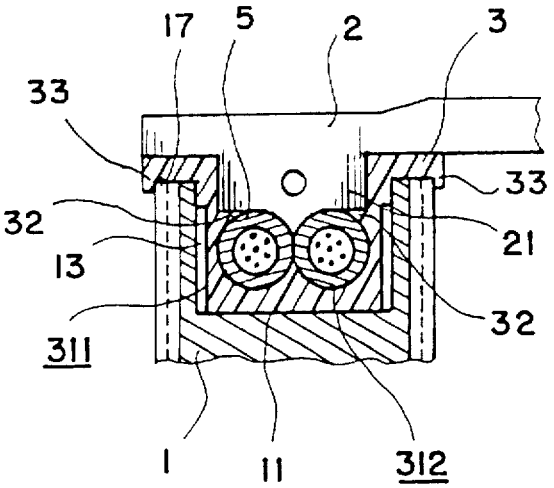
FIG. 2 is a sectional view of the upper part of the present invention, showing the electrical wire supported on the top water seal member in the transverse wire groove of the socket body, and the pressure block of the socket cap pressed on the electrical wire.

Referring to FIG. 2, the top water seal member 3 is fastened to the socket body 1 by inserting the vertical rails 13 of the socket body 1 into the vertical guide grooves 311, permitting the plug portions 31 of the top water seal member 3 to be respectively plugged into the two opposite ends of the transverse wire groove 11 of the socket body 1. When the top water seal member 3 is installed, the bottom mounting groove 33 of the water seal member 3 is forced into engagement with the top edge 17 of the socket body 1. After the installation of the top water seal member 3, the electrical wire 3 is put in the transverse wire groove 11 of the socket body 1, then the socket cap 2 is fastened to the socket body 1 to hold down the electrical wire 5 and the top water seal member 3 by hooking the downward hooks 21 of the socket cap 2 in the retaining holes 12 of the socket body 1 and fitting the pressure block 23 into the transverse wire groove 11 of the socket body 1 When the socket cap 2 is installed, the pressure block 23 is pressed on the electrical wire 5 against the top water seal member 3, causing the top water seal member 3 to deform and to force the wedge blocks 32 into close contact with the electrical wire 5 at the top (see FIG. 2), and therefore the gaps between the socket body 1 and the socket cap 2 around the electrical wire 5 are sealed, and rain water is prohibited from passing through the top end of the socket body 1 into the inside.

Figure 3:
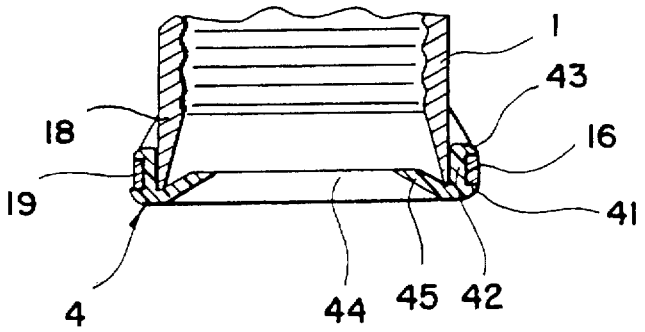
FIG. 3 is a sectional view of the lower part of the present invention, showing the bottom water seal member fastened to the bottom end of the socket body.
Figure 4:
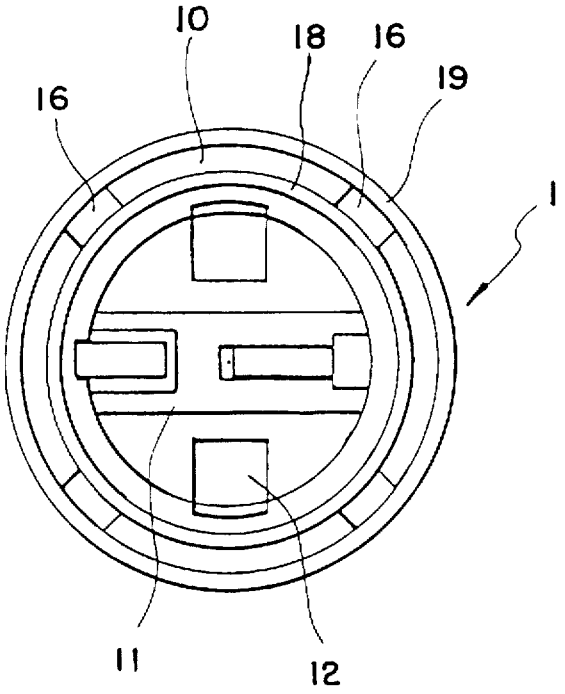
FIG. 4 is a bottom view in an enlarged scale of the lamp socket according to the present invention.

Referring to FIG. 3, the bottom water seal member 4 is fastened to the bottom open end of the socket body 1 by inserting the upright annular flange 42 of the bottom water seal member 4 into the annular bottom groove 10 of the socket body 1 and hooking the upright hooks 43 of the bottom water seal member 4 in the hook holes 16 of the outside annular wall 19 of the socket body 1. When the bulb is threaded into the socket body 1, the inward annular flap 45 is forced to closely attach to the periphery of the bulb, and therefore rain water is prohibited from passing through the bottom open end of the socket body 1 to the inside. When the base of the bulb is threaded into socket body 1 and into engagement with the threaded inner sides of the downward hooks 21, the socket cap 2 is pulled downwards to compress the top water seal member 3, thereby causing the top water seal member 3 and the socket body 1 to be firmly retained together, and therefore no water is allowed to pass through the gap between the socket body 1 and the top water seal member 3.

What the invention claimed is:

1. A lamp socket comprising: a socket body having a close top end, an open bottom end defining a bottom opening adapted for receiving a bulb, a transverse wire groove at said close top end, two retaining holes in said close top end at two opposite sides of said transverse wire groove, a positive metal contact plate and a negative metal contact plate respectively mounted on the inside and having a respective pointed top end projecting into said transverse wire groove; an electrical wire mounted in the transverse wire groove of said socket body; and a socket cap fastened to said the close top end of said socket body, said socket cap comprising a downward pressure block fitted into the transverse wire groove of the socket body and pressed on the electrical wire against the pointed top ends of said positive metal contact plate and said negative metal contact plate, and two downward hooks respectively fastened to the retaining holes of said socket body;

wherein said socket body comprises two pairs of upright rails bilaterally disposed at two opposite ends of said transverse wire groove, an annular bottom groove around the bottom opening of the open bottom end thereof, and a plurality of hook holes in communication with said annular bottom groove;

a first rubber water seal member is mounted on the close top end of said socket body and retained in said transverse wire groove by said socket cap to seal the gap between said socket cap and socket body, said first rubber water seal member comprising two downward plug portions fitted into the two opposite ends of said transverse wire groove of said socket body, two pairs of vertical guide grooves respectively and bilaterally disposed at said downward plug portions and forced into engagement with the vertical rails of said socket body, two double-recess bearing portions respectively formed in said downward plug portions in the middle to support said electrical wire in said transverse wire groove of said socket body, two symmetrical pairs of wedge blocks respectively and bilaterally raised from said downward plug portions at an inner side above the elevation of the double-recess bearing portions and forced into close contact with the periphery of said electrical wire at a top side, and a bottom mounting groove at a bottom side forced into engagement with the topmost edge of the close top end of said socket body;

a second rubber water seal member is mounted around the open bottom end of said socket body to seal the gap between said socket body and the bulb being threaded into the open bottom end of said socket body, said second rubber water seal member comprising a flat annular base closely attached to the open bottom end of said socket body, an upright annular flange raised from said flat annular base and fitted into the annular bottom groove of said socket body, a plurality of upright hooks respectively raised from said upright annular flange and hooked in the hook holes of said socket body, an inward annular flap inwardly and horizontally extended from said flat annular base and defining a center through hole through which the bulb is threaded into said socket body.

2. The lamp socket of claim 1 wherein each of said wedge blocks has a broad top side and a narrow bottom side.

* * * * *